US005583522A

United States Patent [19]

Radomski et al.

[11] Patent Number: 5,583,522

[45] Date of Patent: Dec. 10, 1996

[54] AUTOMOBILE ANTENNA MOUNTING ARRANGEMENT

[75] Inventors: Michael Radomski, Utica; John F. Ellis, Royal Oak, both of Mich.; Kenneth W. Redman, Jr., Edison; Joseph B. Cejka, deceased, late of Fair Haven, both of N.J., by Florence V. Cejka, executrix

[73] Assignee: Chrysler Corporation, Auburn Hills, Mich.

[21] Appl. No.: 368,283

[22] Filed: Jan. 3, 1995

[51] Int. Cl.[6] ..... H01Q 1/32

[52] U.S. Cl. ..... 343/715; 343/888; 343/889

[58] Field of Search ..... 343/715, 906, 343/711, 712, 713, 888, 889, 892, 900, 901, 903; H01Q 1/32

[56] References Cited

U.S. PATENT DOCUMENTS

| | | | |
|---|---|---|---|
| 2,170,684 | 8/1939 | Greenberg et al. | 343/715 |
| 2,203,986 | 6/1940 | Farwell | 343/713 |
| 2,840,816 | 6/1958 | Cejka | 343/715 |
| 2,850,305 | 9/1958 | Chadowski et al. | 343/715 |
| 2,899,485 | 8/1959 | Friedberg et al. | 343/715 |
| 3,276,021 | 9/1966 | Hordasch | 343/715 |
| 5,233,363 | 8/1993 | Yarsunas et al. | 343/715 |

*Primary Examiner*—Hoanganh T. Le
*Attorney, Agent, or Firm*—G. Andrew Barger

[57] ABSTRACT

An improved panel mounting assembly for a vehicle antenna mast wherein the assembly is provided with an anchoring arrangement which eliminates the need for stamping a raised stiffening dimple in the panel design surface contour. A mounting assembly mast tubular holding section, which extends vertically through a panel aperture, is provided with a downwardly extending support tube uniquely coupled to and forming a part of the section lower end. The support tube is held in a subjacent body frame member opening by a snap-fitted rubber grommet permitting limited reciprocal travel of the support tube. The arrangement accommodates vehicle build tolerances between the panel and frame during assembly, while stabilizing the antenna structure against fore, aft and lateral movement relative to the panel.

7 Claims, 3 Drawing Sheets

AUTOMOBILE ANTENNA MOUNTING ARRANGEMENT

BACKGROUND OF THE INVENTION

This invention relates to vehicle antennas and more particularly to an arrangement for mounting an antenna on a vehicle fender panel which anchors the antenna panel mounting assembly to the vehicle frame thereby stabilizing the antenna structure against fore, aft and lateral movement.

An example of a prior art automobile radio antenna having its upper neck portion supported by a vehicle sheet metal exterior panel aperture cap and its lower tubular well portion supported by a bracket anchored to the vehicle frame is shown in U.S. Pat. No. 2,840,816 issued Jun. 24, 1958 to Cejka entitled Radio Antenna.

The U.S. Pat. 5,233,363 issued Aug. 3, 1993 to Yarsunas et al. entitled Connector assembly For Fixed Triband Antenna discloses a vehicle antenna provided with a base section fixedly mounted at its upper end on the vehicle fender and at its lower end to a body mounting strap supporting a removable antenna mast section removably received in the base section.

Further prior art examples of vehicle antenna mounting arrangements are shown in U.S. Pat. Nos. 2,203,986, to C. C. Farwell; 2,170,684, to H. Greenberg et al.; 2,850,305, to J. P. Chadowski; 2,899,485, to M. R. Friedberg et al.; 3,276,021, to G. Horndasch; and 4,198,638, to D. T. Carolus.

SUMMARY OF THE INVENTION

It is a feature of the present invention to provide an improved antenna mounting arrangement for a vehicle exterior body panel which rigidly supports the antenna mast while eliminating the need to stamp a raised stiffening dimple, forming a planar compression mounting area, in the panel design arcuate surface contour while attaining a good radio frequency ground in the panel design arcuate surface contour.

It is a further feature of the present invention to provide an improved antenna mounting arrangement for a vehicle exterior body panel wherein a panel mounting assembly mast holding section, which extends vertically through a panel aperture, has its lower end coupled to a downwardly extending support tube. The lower portion of the support tube is retained in a body frame member aligned opening by a rubber grommet adapted to stabilize the antenna structure against fore, aft and lateral movement relative to the panel.

It is still another feature of the present invention to provide an improved antenna mounting arrangement as set forth above wherein the grommet permits limited vertical adjustment of the mast holding section and support tube accommodating vehicle body build tolerances between the vehicle exterior panel and body frame.

It is yet another feature of the present invention to provide an improved antenna mounting arrangement as set forth above wherein the panel mounting assembly attains a good radio frequency ground with an outwardly arcuate shaped panel mounting surface thereby obviating the need for forming a planar compression surface in the panel arcuate contour for the antenna mounting assembly.

BRIEF DESCRIPTION OF THE DRAWINGS

These and other objects, features and advantages of the invention will appear from the following written description and the accompanying drawings in which.

DETAILED DESCRIPTION OF THE INVENTION

Figure 1:
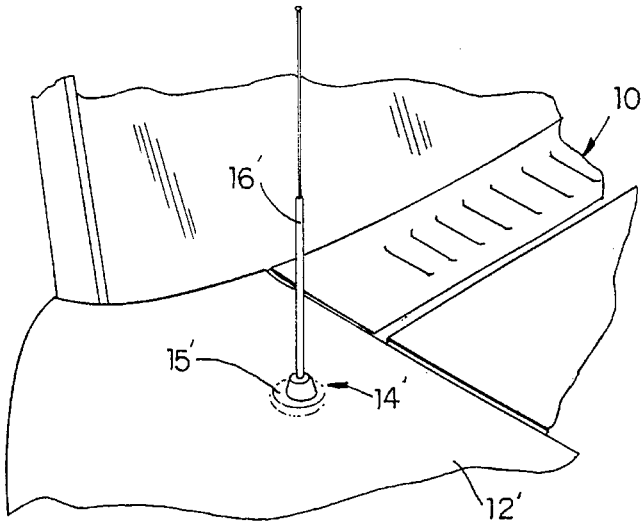
FIG 1 (PRIOR ART)
FIG. 1 is a fragmentary perspective view of a prior art antenna mounting arrangement requiring a raised stiffening dimple in the exterior surface contour of an automotive vehicle panel.
Figure 2:
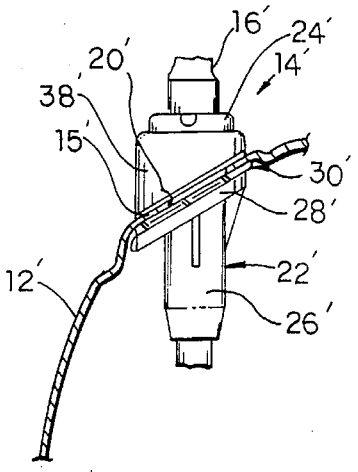
FIG. 2 (PRIOR ART)
FIG. 2 is fragmentary front view, partly in vertical cross section, taken on the line 2—2 of prior art FIG. 1.

Referring now to prior art FIGS. 1 and 2 of the drawings, an automobile vehicle body 10' is shown with its right front fender panel 12' having an antenna mounting assembly 14' wherein the panel is stamped with a dimple forming a raised planar mounting land 15' for supporting an antenna mast 16'. A panel aperture 20' is adapted to receive therein a conventional panel mounting assembly 22'. It will be noted that the mounting assembly 22' includes a nut 24' in threaded engagement with an upper end (not shown) of a tubular mounting section 26'. The nut 24' adapted to be torqued-down on a mating subjacent upper spacer 38'. A mounting section stop flange 28', supporting a panel interior serrated grounding washer 30' on its upper surface, underlies the panel land 15' such that the washer serrations are adapted to penetrate paint and undercoating to establish a good radio frequency (R-F) ground connection to the vehicle body 12'. The panel land 15' is also placed under compression between the upper spaced 38' and the subjacent stop flange 28' by the torqued nut 24' thereby fixedly securing the mast 16 to the vehicle body 10'. It will be noted that is important to ground the mast to the panel 12' to minimize loss of the R-F signal, i.e. good radio frequency transmission from the transmission to the radio receiver.

Figure 3:
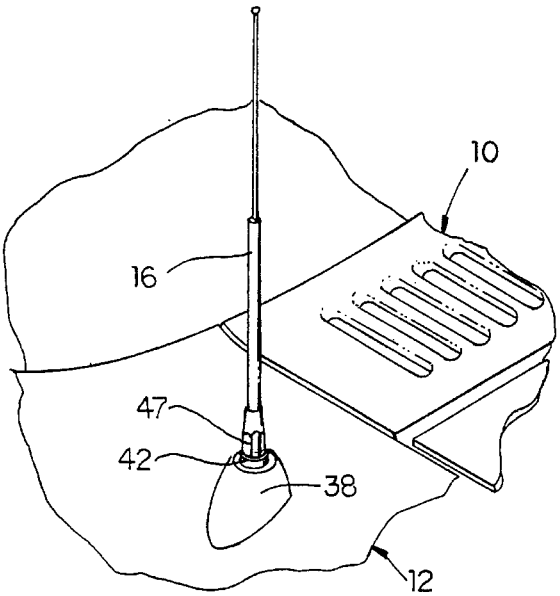
FIG. 3 is a fragmentary perspective view similar to FIG. 1 of an automotive vehicle body fender panel provided with an antenna mounting arrangement in accordance with the present invention.
Figure 4:
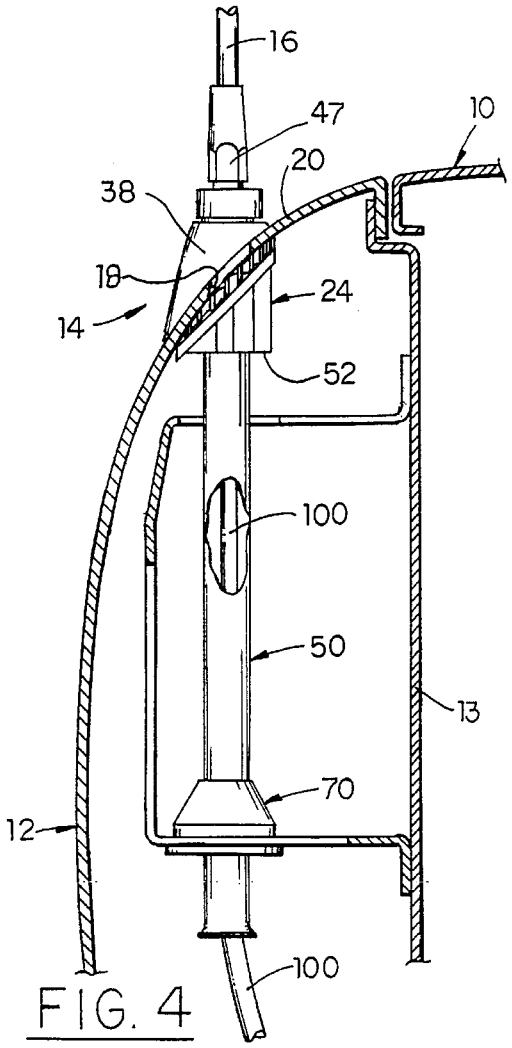
FIG. 4 is a fragmentary vertical cross sectional view, partly in elevation, taken substantially on the line 4—4 of FIG. 3 illustrating a preferred embodiment of the invention.

Turning now to FIGS. 3–9 of the drawings wherein a preferred embodiment of the present invention is shown. FIGS. 3 and 4 show a vehicle body 10 having a right front fender panel 12, supported on an inner body panel 13, provided with an antenna mounting arrangement, generally indicated at 14. A signal receiving cylindrical antenna mast 16 is adapted to be supported in axial alignment with a fender panel aperture shown at 18 in FIG. 6. As seen in FIG. 4 the aperture is formed in an arcuate section 20 of the convex curved fender panel 12.

Figure 8:
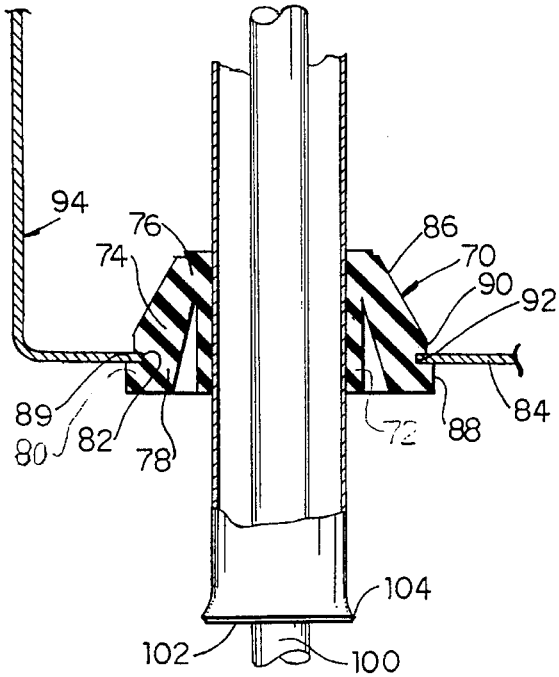
FIG. 8 is an enlarged cross sectional view similar to FIG. 4 showing details of the mounting arrangement.

In FIG. 4 the mast 16 is shown attached to the panel 12 by means of a panel mounting assembly 22. The mounting assembly 22, as best seen in the exploded view of FIG. 6, comprises a tubular mounting section 24 having an upper end 25 and a lower end 26. FIG. 8 shows the mounting section upper end 25 and threaded stem portion 27 extending a predetermined dimension above of the fender panel aperture 18 while section lower end 26 and neck portion 23 are shown extending a predetermined dimension below the fender panel aperture 18. An elliptical-shaped contoured stop flange 28, integral with the mounting section 24, is shown in FIG. 8 projecting laterally beyond the fender panel aperture 18. The stop flange 28 has an upper seating surface 29 providing a fixing support for interior spacer or ground washer 30. With the grounding washer 30 seated and keyed on the stop flange upper surface 29 it is adapted to match the fender panel interior surface contour so as to underlie a surrounding border portion of the aperture 18. The washer 30, which also conforms to the stop flange upper surface 29, has serration 32 adapted to penetrate paint and undercoating to establish a good radio frequency ground connection to the vehicle body 10. It will be noted in FIG. 6 that the upper surface 29 of the shoulder 28 is provided with diametrically opposed axially extending keys 34 adapted to extend through aperture keyways 35 for interlocking engagement with spacer internal orienting prongs 36.

Figure 6:
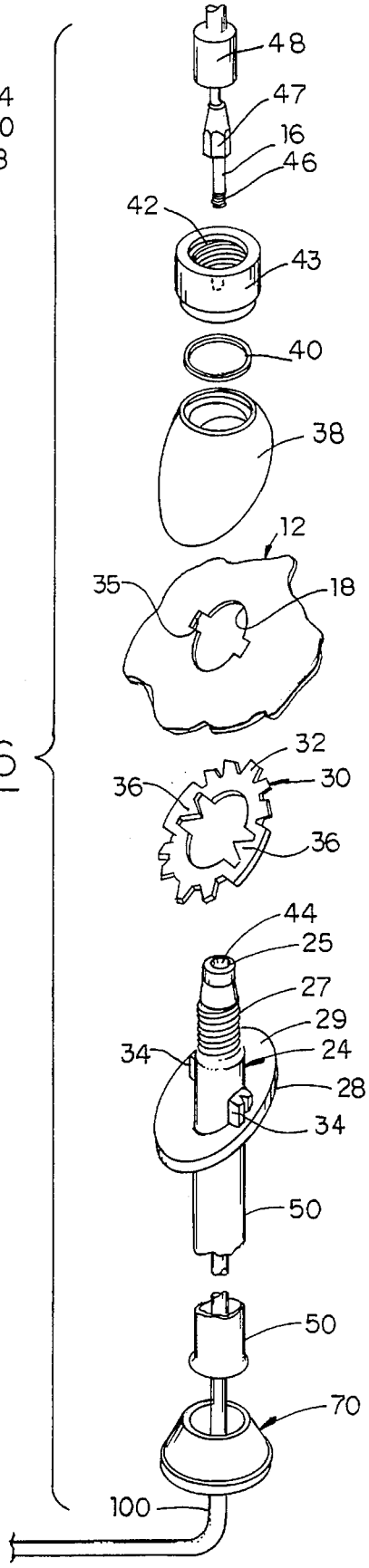
FIG. 6 is a fragmentary exploded perspective view of the antenna upper mounting assembly in relation to its associated body panel aperture.
Figure 7:
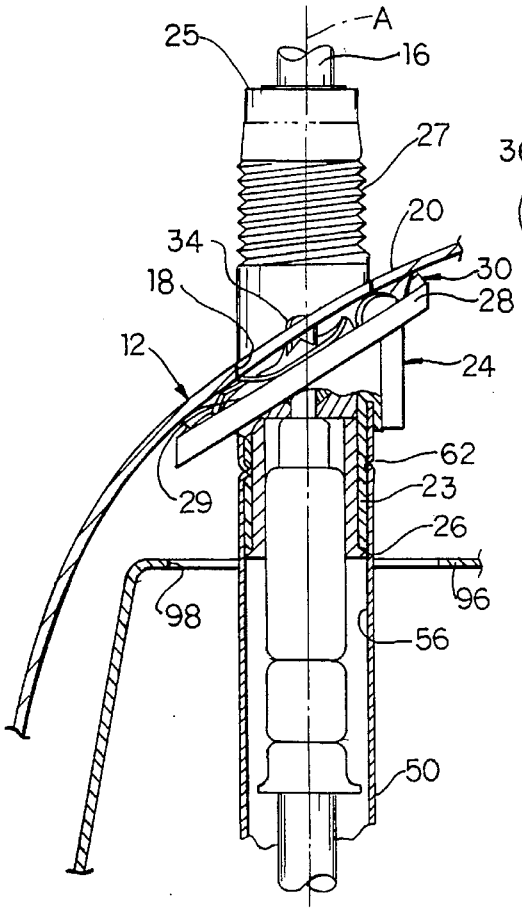
FIG. 7 is an enlarged detail plan view of the grounding lock washer shown in FIG. 6.
Figure 7:
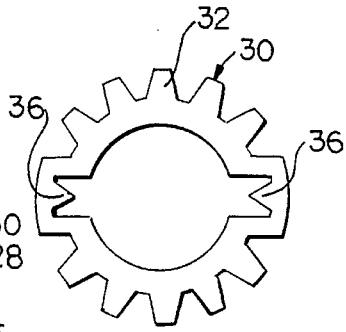
Figure 9:
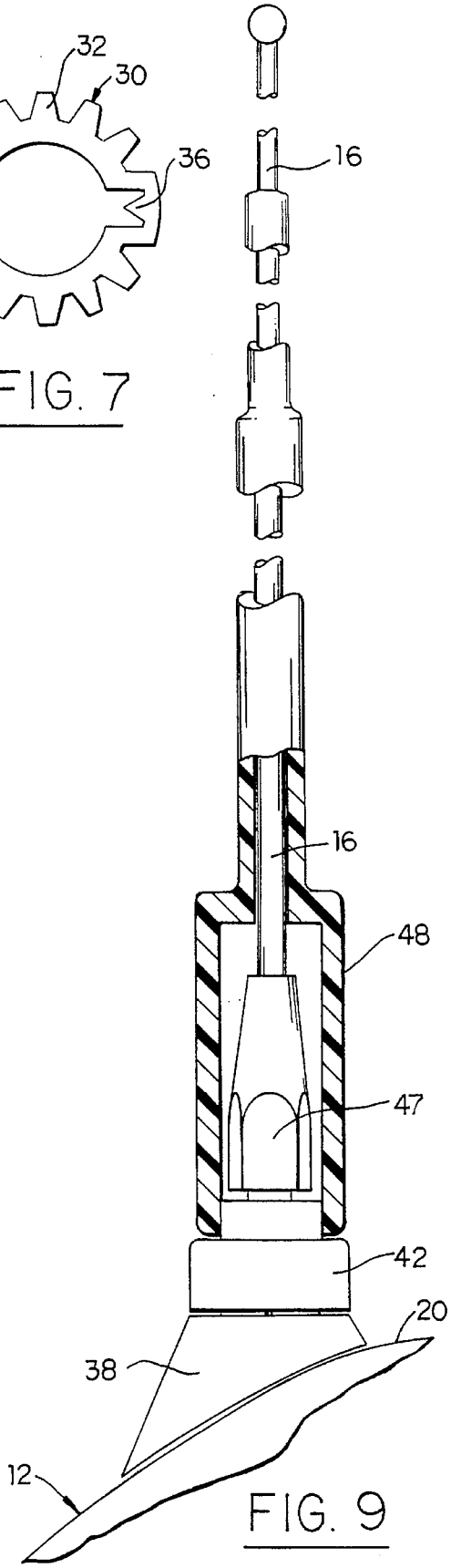
FIG. 9 is an enlarged vertical cross sectional view, partly in elevation, of the antenna mast.

With reference to FIG. 6, the antenna conventional panel mounting assembly further comprises an exterior spacer 38 seating a metal O-ring 40 and retained by an internal cap nut 42 engaging threaded upper stem 27. An outer shroud 43 surrounds the cap nut 42 shroud 43. The mounting section upper end 25 has an internally threaded socket 44 engaging threaded lower threaded end 46 of the mast 16 by means of mast hex head faces 47. FIG. 9 shows the mast hex head faces 47 enclosed by an outer cylindrical cover 48.

As best seen in FIG. 8 the invention provides a downwardly extending elongated cylindrical support tube 50 shown affixed to and forming a part of the of the mounting section 24. It will be seen in FIG. 10 that the tubular mounting section 24 is provided with an intermediate horizontally disposed undercut shoulder 52 formed at its radially inner terminus with the integral concentrically disposed downwardly extending tubular neck 23. Outer cylindrical surface 54 of the neck 23 is sized to telescopically receive, in a close fit manner, inner surface 56 of the support tube 50.

Figure 10:
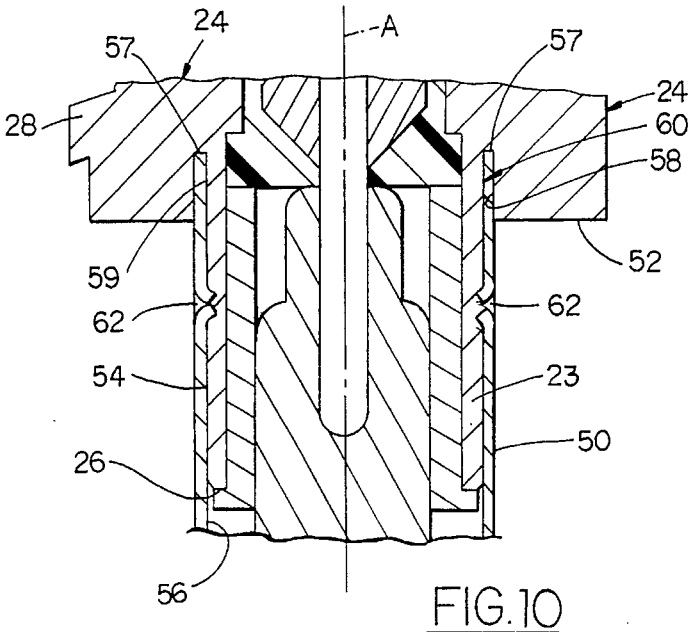
FIG. 10 is an enlarged fragmentary vertical sectional view of the coupling between the upper end of the support tube and the panel mounting section neck.
Figure 5:
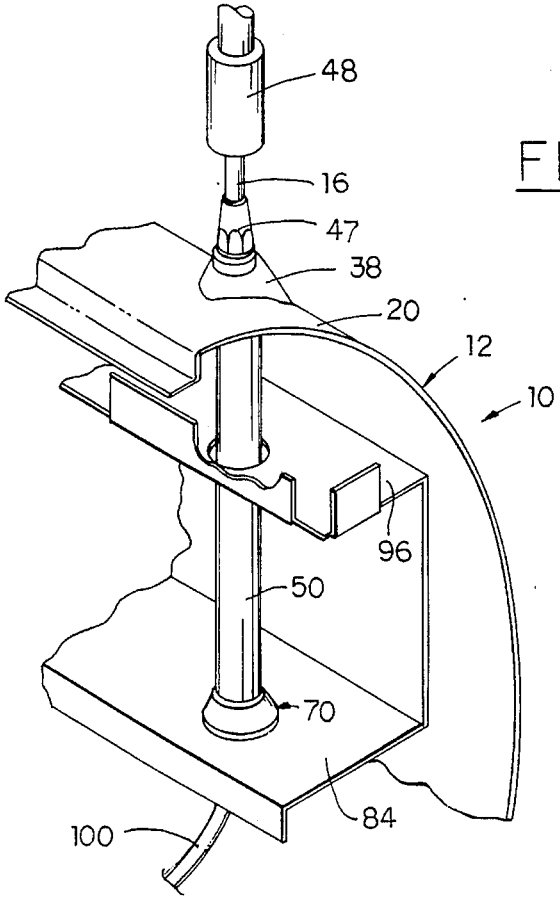
FIG. 5 is a fragmentary perspective view of an interior portion of the fender panel and body structure of FIG. 4 showing details of the antenna mounting arrangement.

It will be seen in FIG. 10 that upper end 57 of the support tube is received in a concentric cylindrical slot, defined by radially outer 58 and inner 59 concentric surfaces. The cylindrical slot, generally indicated at 60, has a predetermined internal diameter closely fitted to the external diameter of the neck 23. The slot 60 extends upwardly from the shoulder 52 a predetermined axial dimension, adapted to snugly receive the tube upper end in a in a lead-in manner. It will be appreciated that the neck 23, which extends downwardly from the shoulder 52, together with the slot 60, which extends upwardly from the shoulder 52, cooperate to increase the rigidity of the coupling between the support tube 50 and neck 24 about their common vertically extending principal axis "A". The support tube 50 is affixed to the neck 23 by suitable fastening means, which in the preferred embodiment is by four equally spaced stakes 62.

With reference to FIG. 8 it will be seen that a one-piece grommet of elastomeric or rubber material is shown generally at 70. The grommet 70 has a central sleeve 72 slidably receiving the support tube 50 therethrough so as to surround a lower portion of the support tube in its design position of FIG. 8. The grommet is concentrically surrounded by an annular outer axially coextensive frusto-conical shaped collar 74. The collar converges upwardly and inwardly from a large diameter lower end and terminates at a small diameter upper end where it forms an integral juncture 76 with the upper end of the central sleeve 72. The collar lower end terminates in an annular stepped base 78 formed with a continuous annular radially outer groove 80 for securing the grommet in a snap-fit manner in circular opening 82 of the subjacent horizontally extending body frame plate 84. FIG. 8 shows the center of the circular opening 82 being aligned on the principal axis "A" of the support tube 50 and the vertically aligned tubular mounting section 24. It will be further noted that the frame member 84 circular opening 80 has a predetermined diameter sized to allow upward passage therethrough of the mast support section 24 including its surrounding stop flange 28.

As shown in FIG. 8 grommet conical surface 86 allows self-centering of the grommet upon the grommet being urged upwardly into the frame opening 82. Further, grommet base 78 has a lower annular face 88, positioned below slot bottom surface 89, which is off-set radially outwardly from a upper annular face 90, above slot upper surface 92. The slot lower offset face 89 provides for the snap-in capture of the grommet in the frame opening 82. FIG. 8 of the disclosed embodiment depicts the body frame plate 84 as part of a U-shaped frame member 94 having an upper frame plate 96. It will be appreciated that a clearance opening 98, aligned with opening 82, must also be provided in the upper frame plate 96 to allow upward passage of the antenna mounting section 24.

FIG. 8 shows a coaxial cable 100 extending upwardly through the lower open end 102 of the support tube 50 for conventional connection to the mast 16. It will be noted the support tube lower end is radially enlarged at 104 to capture the grommet 70 thereon so as to facilitate assembly line installation of the antenna.

As a specific example, the support tube 50 and mounting section 24 has a predetermined overall height of about 285 mm while the mast 16 has a predetermined overall height of about 817 mm. As the resilient grommet 70 is positioned about 40 mm above the support tube lower end 102 it will be seen that the grommet resiliently anchors the mast 16 and mounting section 24 a predetermined axial dimension below the panel aperture 18 about one-third the predetermined over all axial height of the mast 16 and section 24 above the panel aperture. Thus, the support tube grommet or "footing" provides a one-third leveraged factor for the mast 16 and section 24 operative for stablizing the mounting section 24 and mast 16 against fore, aft and lateral movement in the arcuate sectioned sheet metal fender panel 12.

While the principles of the present invention in connection with the specific test device has been described, it is to be understood the foregoing detailed description has been made by way of example only and not as a limitation to the scope of the invention as set for in the accompanying claims.

What is claimed is:

1. An antenna structure for mounting on a vehicle body including a rod-like antenna mast and a mounting assembly for supporting the mast at an aperture in a body panel, the mounting assembly providing a mounting section extending vertically through the panel aperture with its upper end having means for fixedly securing a lower extremity of the mast above the aperture, and an arrangement for anchoring the mounting section to a vehicle body frame, the arrangement comprising:

said section having a surrounding stop flange portion intermediate its upper and lower ends, said stop flange portion defining an upper seating surface juxtaposed an opposed interior surface portion of said panel bordering said aperture, said section stop flange portion terminating in a downwardly extending concentric neck, said neck and said stop flange portion, defining an undercut radial shoulder;

a downwardly extending elongated cylindrical support tube, coupling means for fixedly securing an upper portion of said support tube to said neck;

a circular opening formed through an underlying vehicle body frame member concentrically receiving a lower end portion of said support tube therethrough;

a one-piece cylindrical rubber grommet slidably surrounding said support tube adjacent a lower end thereof, said grommet formed with a continuous annular groove for snap-fitting engagement in the frame member circular opening; and whereby said grommet allowing free vertical reciprocal travel of said support tube and mounting section relative to said frame member thereby compensating for build tolerances between the panel and the frame member, said arrangement operative for stabilizing said mounting section against fore, aft and lateral movement in the panel aperture.

2. The antenna mounting arrangement as set forth in claim 1 wherein said frame member circular opening having a diameter a predetermined dimension so as to allow said mounting assembly section to pass upwardly therethrough prior to being received in the panel aperture.

3. The antenna mounting arrangement as set forth in claim 1 wherein said grommet adapted for vertical upward sliding movement on said support tube, upon said section being received in the panel aperture, for snap-fit engagement in said frame member opening.

4. The antenna mounting arrangement as set forth in claim 1 wherein said coupling means in the form of a mounting section undercut shoulder located intermediate said section flanged stop and lower end, said neck defining an exterior cylindrical surface sized to telescopically receive thereon an upper end of said support tube, and a concentrically disposed cylindrical slot extending upwardly from shoulder, said slot having its radially inner surface in common with the outer surface of said support tube, said cylindrical slot sized to telescopically receive therein said support tube upper end, and said support tube being fixedly secured to said neck by staking.

5. The antenna mounting arrangement as set forth in claim 1 wherein said body subjacent frame having a circular opening therein vertically aligned on said support tube principal axis, said frame opening of a predetermined diameter allowing passage therethrough of said mast support section surrounding stop flange.

6. The antenna mounting arrangement as set forth in claim 1 wherein said grommet comprising a central sleeve slidably surrounding said support tube adjacent a lower end thereof, said grommet having an annular upwardly and inwardly converging frusto-conical sectioned flexible outer collar concentrically disposed about said sleeve, said outer collar having a large diameter lower end radially spaced from said sleeve and a small diameter upper end forming an integral juncture with an upper end of said sleeve, said grommet terminating at a lower end thereof in an annular base formed with a continuous annular groove for snap fitting engagement in the frame member circular opening.

7. The antenna mounting arrangement as set forth in claim 1 wherein said support tube and mounting section having a predetermined overall height of about 285 mm and said mast having an overall height of about 817 mm, whereby said grommet resiliently anchoring said mast and mounting section a predetermined axial dimension below said panel aperture about one-third of the predetermined axial height of said mast and mounting section above said panel aperture.

* * * * *